US005702232A

United States Patent [19]

Moore

[11] Patent Number: 5,702,232

[45] Date of Patent: Dec. 30, 1997

[54] COOLED AIRFOILS FOR A GAS TURBINE ENGINE

[75] Inventor: Robert P. Moore, Tequesta, Fla.

[73] Assignee: United Technologies Corporation, Hartford, Conn.

[21] Appl. No.: 354,299

[22] Filed: Dec. 13, 1994

[51] Int. Cl.[6] ..... F01D 5/18

[52] U.S. Cl. ..... 416/95; 416/96 R; 416/97 R

[58] Field of Search ..... 416/90 R, 91, 416/92, 95, 96 R, 97 R, 97 A, 96 A

[56] References Cited

U.S. PATENT DOCUMENTS

| | | | |
|---|---|---|---|
| 3,698,834 | 10/1972 | Meginnis | 416/96 |
| 4,063,851 | 12/1977 | Weldon | 416/97 A |
| 4,183,716 | 1/1980 | Takahara et al. | 416/96 A |
| 4,529,357 | 7/1985 | Holland | 416/96 R |
| 4,770,608 | 9/1988 | Anderson et al. | 416/97 R |
| 5,215,431 | 6/1993 | Derrien | 416/97 R |
| 5,348,446 | 9/1994 | Lee et al. | 416/97 R |
| 5,383,766 | 1/1995 | Przihembel et al. | 416/97 A |
| 5,392,515 | 2/1995 | Auxier et al. | 416/96 A |
| 5,405,242 | 4/1995 | Auxier et al. | 416/97 R |

FOREIGN PATENT DOCUMENTS

| | | | |
|---|---|---|---|
| 1210253 | 2/1963 | Germany | 416/96 |
| 243324 | 9/1969 | U.S.S.R. | 416/96 |
| 895077 | 5/1962 | United Kingdom | 416/95 |

*Primary Examiner*—Michael J. Carone
*Assistant Examiner*—Theresa M. Wesson

[57] ABSTRACT

An internally cooled airfoil for a gas turbine engine includes a leading edge region, a mid-chord region, a transition region, and a trailing edge region. The mid-chord region has a double wall configuration with the two outer walls and two inner walls. The trailing edge region has a conventional single wall configuration. The transition region has a three wall configuration designed to provide a gradual transition from the four wall configuration to the two wall configuration and to minimize high stresses therein.

4 Claims, 4 Drawing Sheets

COOLED AIRFOILS FOR A GAS TURBINE ENGINE

CROSS REFERENCE TO RELATED APPLICATIONS

The subject matter of this application is related to the subject matter of commonly owned U.S. patent application Ser. No. 07/236,092 filed on Aug. 24, 1988 and entitled "Cooled Blades For A Gas Turbine Engine" still pending.

TECHNICAL FIELD

This invention relates to gas turbine engines and, more particularly, to internally cooled airfoils therefor.

BACKGROUND OF THE INVENTION

A gas turbine engine includes a compressor, a combustor, and a turbine. Air flows axially through the engine. As is well known in the art, the compressed gases emerging from the compressor are mixed with fuel in the combustor and burned therein. The hot products of combustion, emerging from the combustor at high pressure, enter the turbine where the hot gases produce thrust to propel the engine and to drive the turbine, which in turn drives the compressor.

Both the compressor and the turbine include alternating rows of rotating and stationary airfoils. The airfoils operate in an especially hostile environment that is characterized by high pressure, high temperature, and repeated thermal cycling. For example, the temperature of hot combustion gases entering the turbine generally exceeds the melting point temperatures of the alloys from which the turbine airfoils are fabricated. Thus, to properly perform in such a harsh environment, the airfoils must be cooled.

One effective cooling method is described in U.S. patent application Ser. No. 07/236,092 to Auxier et al, entitled "Cooled Blades For A Gas Turbine Engine" and assigned to Pratt & Whitney, a division of United Technologies Corporation of Hartford, Conn., the assignee of the present invention. The disclosed airfoil includes a double wall configuration in the mid-chord region thereof with a plurality of radial feed passages defined on each side of the airfoil between an inner wall and an outer wall. A central radially extending feed chamber is defined between the two inner walls. The trailing edge of the airfoil, shown in the aforementioned patent application, includes a conventional single wall configuration with two outer walls defining a sequence of trailing edge passages therebetween.

Although the disclosed airfoil provides an effective cooling configuration, an improvement is needed to minimize stress in the interface area between the double wall configuration in the mid-chord region and the single wall configuration in the trailing edge. The high local stress in the interface area results from the transition from a four wall configuration in the mid-chord section to a two wall configuration in the trailing edge. In addition, a thermal difference within the interface area contributes to high stress therein. The thermal difference arises as the two outer walls in the mid-chord region merge with the two inner walls and transition to two walls in the trailing edge region. The outer walls of the mid-chord region are exposed to the hot gases and, despite the cooling, remain relatively hot. The two inner walls are shielded by the feed passages on one side and cooled by the feed chamber on the other side, and therefore remain relatively cool. The two outside walls in the trailing edge region remain relatively hot. As the two hot outer walls and two cooler inner walls of the mid-chord region merge into two hot walls in the trailing edge region, high stress is produced. These high stresses in the interface area must be reduced to improve the durability of the airfoil.

DISCLOSURE OF THE INVENTION

According to the present invention, a gas turbine engine airfoil having a leading edge region, a mid-chord region, and a trailing edge region with the mid-chord region having a double wall configuration and with the trailing edge region having a single wall configuration includes a transition region between the mid-chord region and the trailing edge region to minimize stress within the airfoil. The transition region includes a transition feed passage and a transition chamber. The transition feed passage and the transition chamber are separated by a transition inside wall, thereby resulting in a three wall configuration within the transition region.

The three wall configuration in the transition region reduces stress in the airfoil. The stress is minimized due to gradual structural and thermal transitions from the four wall configuration in the mid-chord region to the three wall configuration in the transition region to the two wall configuration in the trailing edge region. Furthermore, the transition feed passage provides shielding to the transition chamber, thereby improving cooling in the transition region. Cooler air in the transition region also translates into cooler air in the trailing edge, thereby improving cooling within the trailing edge region.

The foregoing and other advantages of the present invention become more apparent in light of the following detailed description of the exemplary embodiments thereof, as illustrated in the accompanying drawings.

BEST MODE FOR CARRYING OUT THE INVENTION

Figure 1:
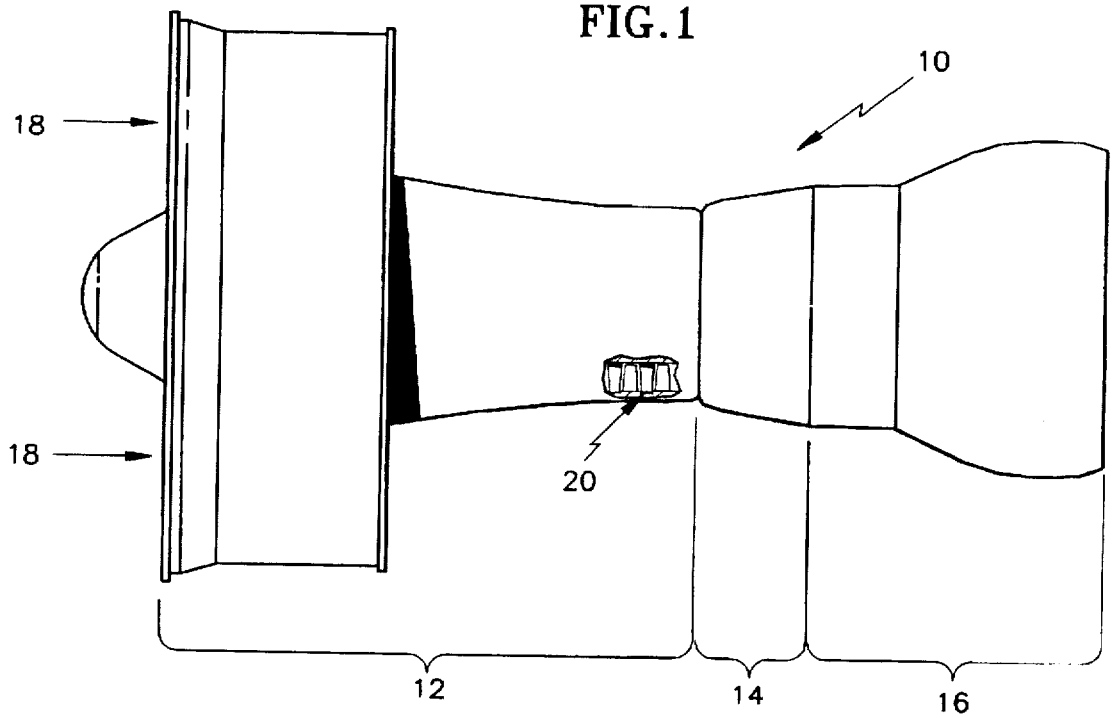
FIG. 1 is a schematic representation of a gas turbine engine.

Referring to FIG. 1, a gas turbine engine 10 includes a compressor 12, a combustor 14, and a turbine 16. Air 18 flows axially through the engine 10. As is well known in the art, air 18 is compressed in the compressor 12. Subsequently, the compressor air is mixed with fuel and burned in the combustor 14. The hot products of combustion enter the turbine 16, wherein the hot gases expand to produce thrust that propels the engine 10 and drives the turbine 16, which in turn drives the compressor 12.

Figure 2:
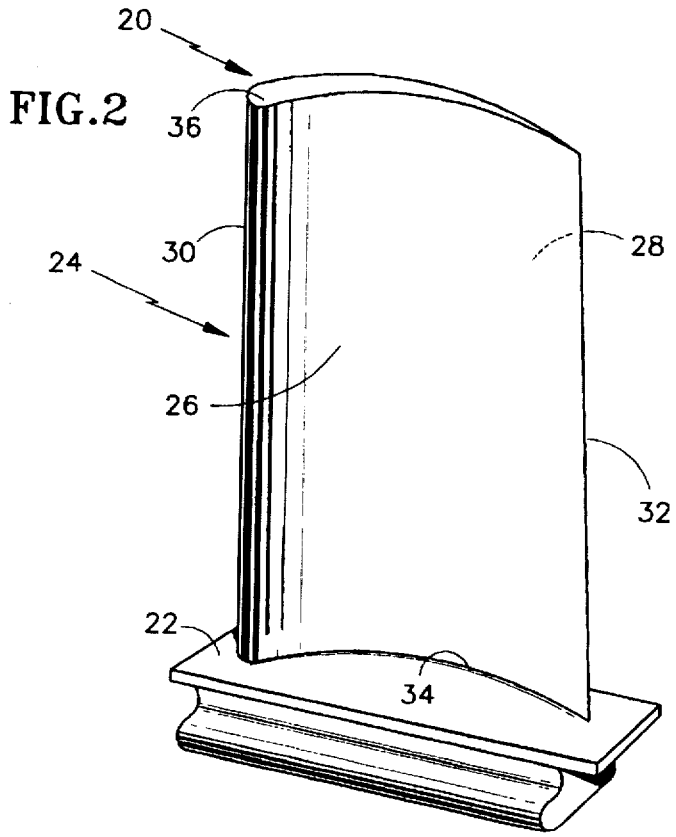
FIG. 2 is a perspective view of an airfoil of the gas turbine engine of FIG. 1.
Figure 3:
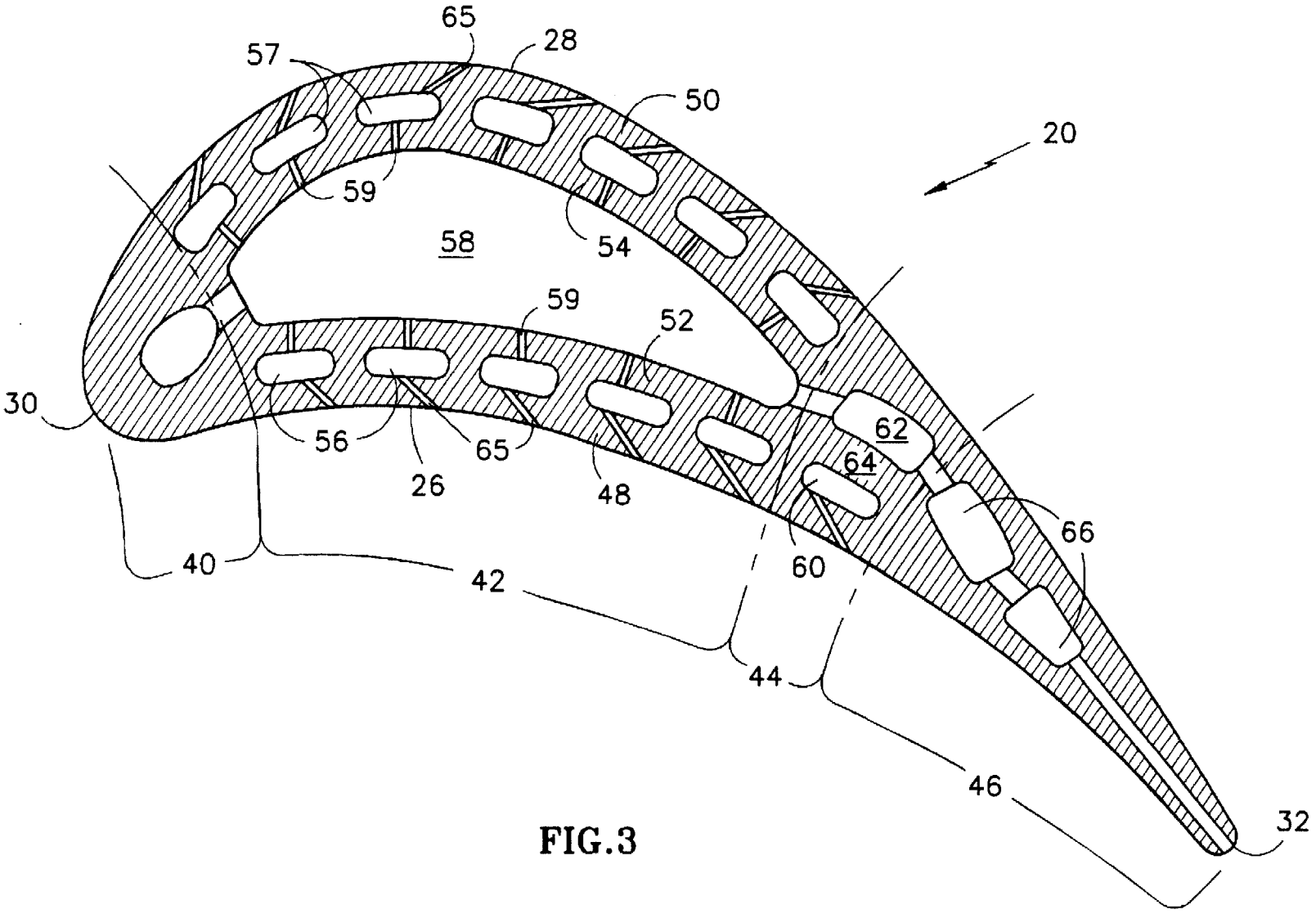
FIG. 3 is a sectional view of the airfoil of FIG. 2, according to the present invention.

Both the compressor 12 and the turbine 16 include alternating rows of rotating and stationary airfoils 20. Referring to FIG. 2, each airfoil 20 includes a platform 22 and an airfoil portion 24. The airfoil portion 24 includes a pressure side 26 and a suction side 28 extending in the chordwise direction from a leading edge 30 to a trailing edge 32 and in the spanwise direction from a root 34 to a tip 36. Referring to FIG. 3, each airfoil portion 24 includes a leading edge region 40, a mid-chord region 42, a transition region 44, and a trailing edge region 46. The regions 40, 42, 44, and 46, extend sequentially chordwise from the leading edge 30 to the trailing edge 32.

The mid-chord region 42 includes a double wall configuration having outer walls 48, 50 and inner walls 52, 54 on the pressure side 26 and suction side 28, respectively. A plurality of pressure side feed passages 56 is disposed between the outer wall 48 and the inner wall 52 in the mid-chord region 42. A plurality of suction side feed passages 57 is disposed between the outer wall 50 and the inner wall 54 in the mid-chord region 42. A feed chamber 58 is disposed between the two inner walls 52, 54 in the mid-chord region 42. A plurality of resupply holes 59 allows communication between the feed passages 56, 57 and the feed chamber 58.

The transition region 44 includes a transition feed passage 60 and a transition chamber 62 separated by a transition inside wall 64 and bounded by the pressure side outer wall 48 and the suction side outer wall 50. The cooling air exits the feed passages 56, 57 and the transition feed passage 60 through a plurality of film holes 65 formed within the outer walls 48, 50.

The trailing edge region 46 includes a plurality of trailing edge passages 66 sequentially situated therein and bound by the pressure side outer wall 48 and the suction side outer wall 50.

During operation of the gas turbine engine 10, cooling air enters the feed passages 56, 57 and feed chamber 58 at the root 34 and centrifuges towards the tip 36 of the airfoil 20. Cooling air exits the feed passages 56, 57 through the film holes 65 to cool the outer walls 48, 50. As the cooling air is depleted through the film holes 65, the feed passages 56, 57 are resupplied with the cooling air from the feed chamber 58 through the resupply holes 59. Although cooling air exiting through the film holes 65 cools the outer walls 48, 50 in the mid-chord region, the outer walls 48, 50 remain relatively hot. The inner walls 52, 54 in the mid-chord region are shielded from the outside ambient temperatures by the feed passages 56, 57 on one side of each wall 52, 54 and cooled by the cooling air circulating in the feed chamber 58 on the other side of each wall 52, 54. Therefore, the inner walls 52, 54 remain relatively cold.

The outside walls 48, 50 in the transition region 44 remain relatively hot. The transition inside wall 64 is relatively cool because it is shielded by the transition feed passage 60 on the pressure side 26 and by the transition chamber 62 on the suction side 28.

The trailing edge cooling is accomplished by cooling air circulating through the trailing edge passages 66. The outside walls 48, 50 on the pressure side 26 and the suction side 28, respectively, in the trailing edge region 46 remain relatively hot.

Figure 4:
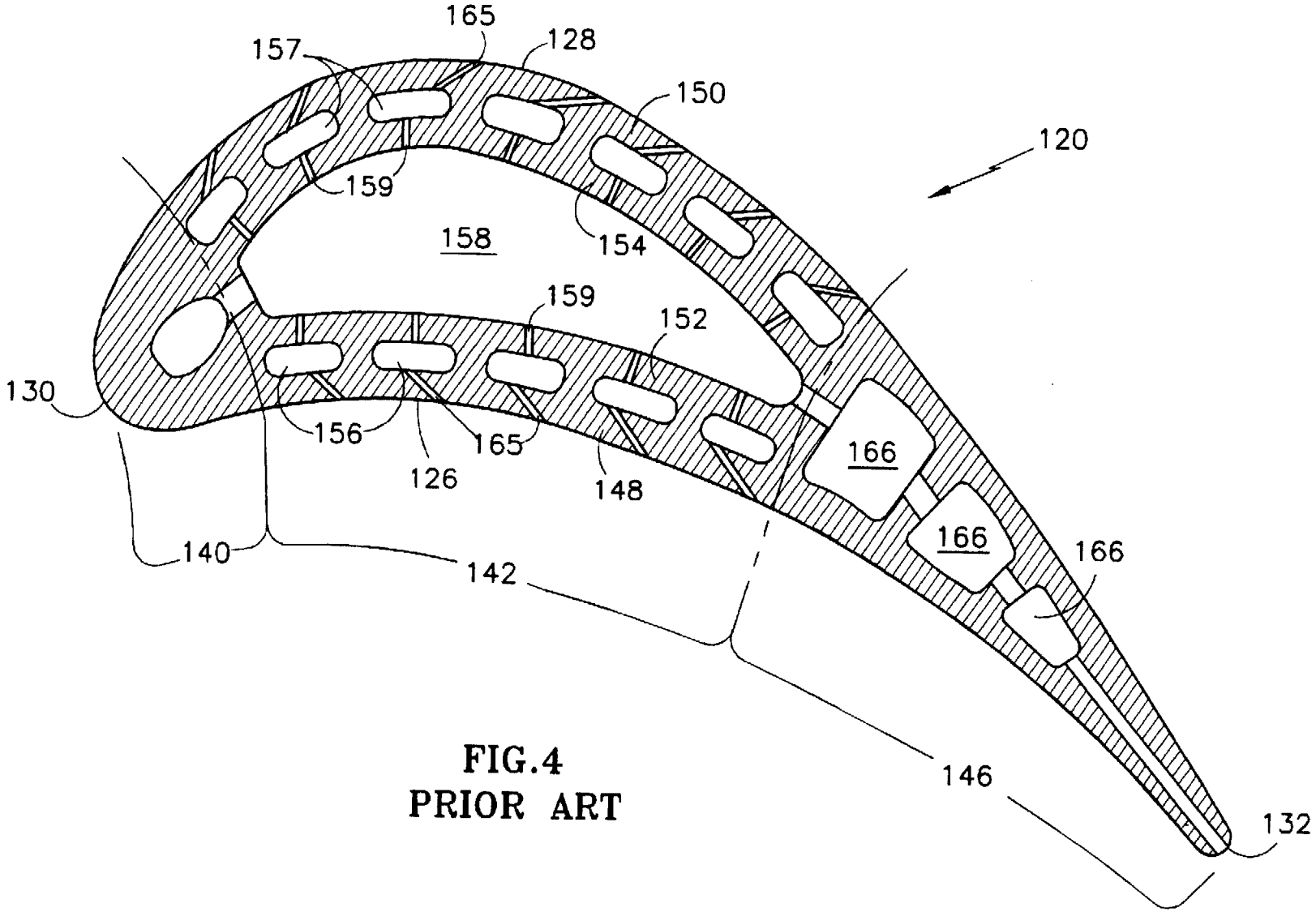
FIG. 4 PRIOR ART
FIG. 4 is a sectional view of an airfoil according to the prior art.

The inclusion of the transition region minimizes stress in the airfoil 20, over the prior art airfoil 120 as depicted in FIG. 4. The prior art airfoil 120 does not have a transition region, resulting in excessive stress at the interface between the mid-chord region 142 and the trailing edge region 146. The excessive stress arises due to the double wall configuration transitioning to a single wall configuration.

One advantage of the airfoil of the present invention over the airfoil of the prior art is that stress is minimized. The stress is significantly reduced because the four wall configuration in the mid-chord region 42 transitions to a three wall configuration in the transition region 44 and eventually to a two wall configuration in the trailing edge region 46, as shown in FIG. 3. The transition region 44 aiso provides for gradual thermal transition of merging two hot outer walls 48, 50 and two cooler walls 52, 54 of the mid-chord region with the two hot walls of the trailing edge region. The gradual structural and thermal transitions decrease the stress in the airfoil.

Another advantage of the present invention is that the transition feed passage 60 provides shielding to the transition chamber 62. The shielding allows the air within the trailing edge passage 62 to remain cooler and therefore supply cooler air to the trailing edge passages 66. The configuration of the present invention provides better cooling in the trailing edge than the airfoil 120 of FIG. 4.

Although the transition feed passage 60 is depicted as being disposed on the pressure side 26 of the transition chamber 62, the transition feed passage 60 can be disposed on the suction side 28 of the transition chamber 62. The exact positioning of the transition feed passage 60 does not alter the benefits of the present invention of minimizing thermal loading in the transition region and providing additional shielding and cooling in the trailing edge region.

Figure 5:
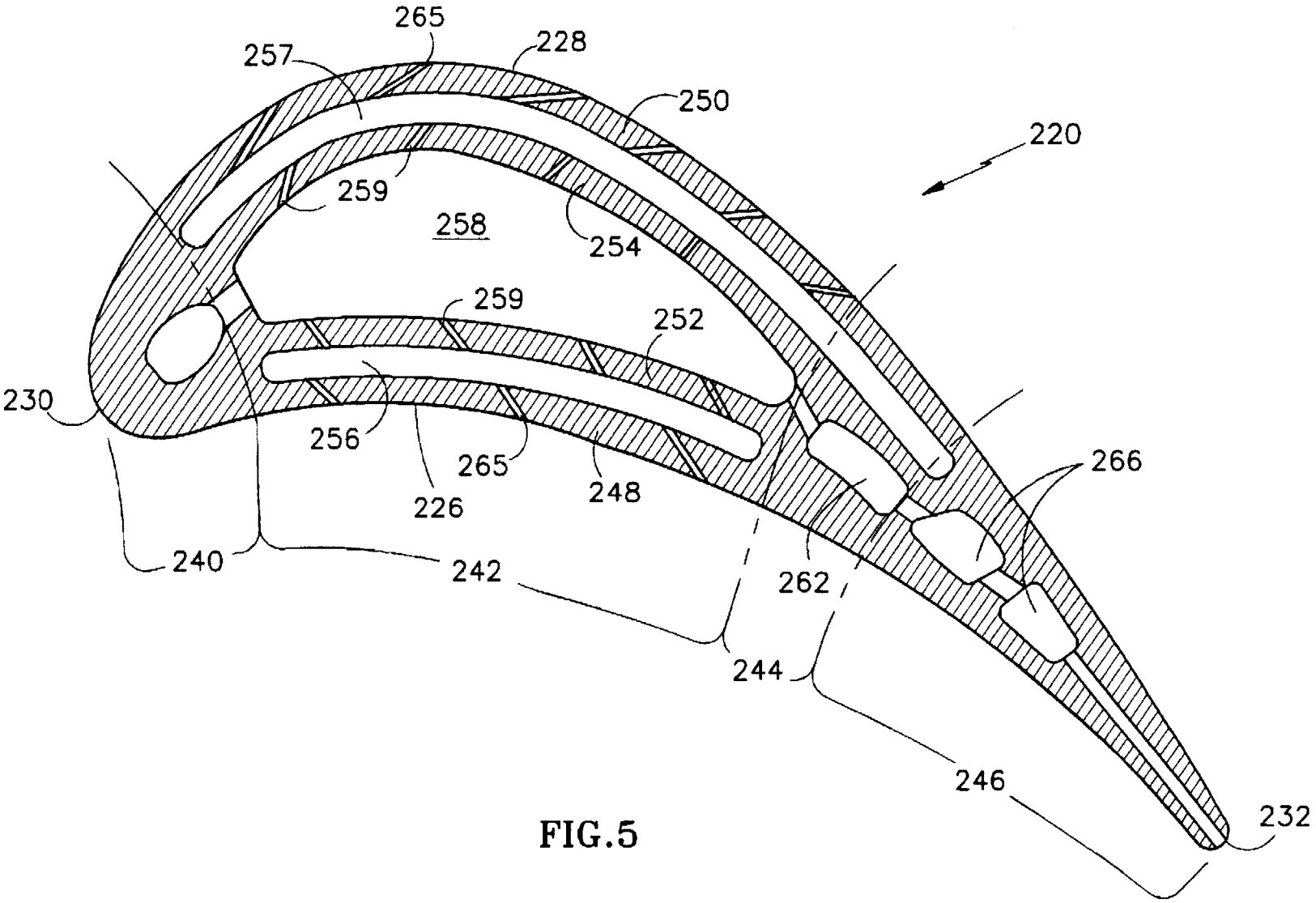
FIG. 5 is a sectional view of an alternate embodiment of the airfoil of FIG. 2.

An alternate embodiment of the present invention is illustrated in FIG. 5. The airfoil 220 is analogous to the airfoil 20 of FIG. 3, with the exception of feed passages 56, 57. A single pressure side feed passage 256 extends through the mid-chord region 242 of the airfoil 220 on the pressure side 226 thereof. A single suction side feed passage 257 extends through the mid-chord region 242 of the airfoil 220 on the suction side 228 thereof. The suction side feed passage 257 extends into the transition region 244 of the airfoil 220 to provide shielding for the transition chamber 262 and to provide a gradual transition from a four wall configuration in the mid-chord region 242 to a two wall configuration in the trailing edge region 246.

Although the invention has been shown and described with respect to exemplary embodiments thereof, it should be understood by those skilled in the art that various changes, omissions, and additions may be made thereto, without departing from the spirit and scope of the invention. For example, the feed chamber 58 may include a plurality of smaller feed chambers.

I claim:

1. An airfoil for a gas turbine engine having a suction side wall on a suction side and a pressure side wall on a pressure side, said pressure side wall and said suction side wall extending from a leading edge to a trailing edge in a chordwise direction, said airfoil having a leading edge region, a mid-chord region, and a trailing edge region, said regions sequentially situated in said chordwise direction from said leading edge to said trailing edge, said mid-chord region having at least one suction side feed passage and at least one pressure side feed passage, said suction side feed passage being disposed on said suction side and bound by said suction side wall and a first inner wall, said pressure side feed passage being disposed between said pressure side wall and a second inner wall, a feed chamber being defined between said first inner wall and said second inner wall, said trailing edge region having at least one trailing edge passage disposed between said pressure side wall and said suction side wall, said airfoil characterized by:

a transition region disposed between said mid-chord region and said trailing edge region, said transition region having a transition feed passage and a transition chamber, said transition feed passage and said transition chamber being separated by said first inner wall extending from said mid-chord region into said transition region in said chordwise direction and bound by said suction side wall and said pressure side wall.

2. An airfoil for a gas turbine engine having a suction side wall on a suction side and a pressure side wall on a pressure side, said pressure side wall and said suction side wall extending from a leading edge to a trailing edge in a chordwise direction, said airfoil having a leading edge region, a mid-chord region, and a trailing edge region, said regions sequentially situated in said chordwise direction from said leading edge to said trailing edge, said mid-chord region having at least one suction side feed passage and at least one pressure side feed passage, said suction side feed passage being disposed on said suction side and bound by said suction side wall and a first inner wall, said pressure side feed passage being disposed between said pressure side wall and a second inner wall, a feed chamber being defined between said first inner wall and said second inner wall, said trailing edge region having at least one trailing edge passage disposed between said pressure side wall and said suction side wall, said airfoil characterized by:

a transition region disposed between said mid-chord region and said trailing edge region, said transition region including a transition chamber, said pressure side feed passage extending into said transition region, said pressure side feed passage extending into said transition region, said pressure side feed passage and said transition chamber being separated by said second inner wall extending into said transition region in said chordwise direction and bound by said suction side wall and said pressure side wall to reduce stress concentration in said airfoil.

3. An airfoil for a gas turbine engine having a suction side wall on a suction side and a pressure side wall on a pressure side, said pressure side wall and said suction side wall extending from a leading edge to a trailing edge in a chordwise direction, said airfoil having a leading edge region, a mid-chord region, and a trailing edge region, said regions sequentially situated in said chordwise direction from said leading edge to said trailing edge, said mid-chord region having at least one suction side feed passage and at least one pressure side feed passage, said suction side feed passage being disposed on said suction side and bound by said suction side wall and a first inner wall, said pressure side feed passage being disposed between said pressure side wall and a second inner wall, a feed chamber being defined between said first inner wall and said second inner wall, said trailing edge region having at least one trailing edge passage disposed between said pressure side wall and said suction side wall, said airfoil characterized by:

a transition region disposed between said mid-chord region and said trailing edge region, said transition region including a transition chamber, said suction side feed passage extending into said transition chamber, said suction side feed passage extending into said transition region, said suction side feed passage and said transition chamber being separated by said first inner wall extending into said transition region in said chordwise direction and bound by said suction side wall and said pressure side wall to minimize stress concentration in said airfoil.

4. An airfoil for a gas turbine engine having a suction side wall on a suction side and a pressure side wall on a pressure side, said pressure side wall and said suction side wall extending from a leading edge to a trailing edge in a chordwise direction, said airfoil having a leading edge region, a mid-chord region, and a trailing edge region, said regions sequentially situated in said chordwise direction from said leading edge to said trailing edge, said mid-chord region having at least one suction side feed passage and at least one pressure side feed passage, said suction side feed passage being disposed on said suction side and bound by said suction side wall and a first inner wall, said pressure side feed passage being disposed between said pressure side wall and a second inner wall, a feed chamber being defined between said first inner wall and said second inner wall, said trailing edge region having at least one trailing edge passage disposed between said pressure side wall and said suction side wall, said airfoil characterized by:

a transition region disposed between said mid-chord region and said trailing edge region, said transition region having a transition feed passage and a transition chamber, said transition feed passage and said transition chamber being separated by said second inner wall extending from said mid-chord region into said transition region in said chordwise direction and bound by said suction side wall and said pressure side wall.

* * * * *